US008833907B2

(12) United States Patent
Kinokuni

(10) Patent No.: US 8,833,907 B2
(45) Date of Patent: Sep. 16, 2014

(54) LIQUID DISCHARGE HEAD AND IMAGE FORMING APPARATUS

(71) Applicant: Takashi Kinokuni, Tokyo (JP)

(72) Inventor: Takashi Kinokuni, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/741,503

(22) Filed: Jan. 15, 2013

(65) Prior Publication Data

US 2013/0182044 A1 Jul. 18, 2013

(30) Foreign Application Priority Data

Jan. 16, 2012 (JP) ..... 2012-006175

(51) Int. Cl.

| | |
|---|---|
| ***B41J 2/14*** | (2006.01) |
| ***B41J 2/16*** | (2006.01) |
| ***B41J 19/00*** | (2006.01) |
| ***B41J 2/175*** | (2006.01) |

(52) U.S. Cl.

CPC ..... *B41J 2/17526* (2013.01); *B41J 19/005* (2013.01)

USPC ..... 347/50

(58) Field of Classification Search

CPC ..... B41J 2/14072; B41J 2/17526; B41J 2002/14491; B41J 2202/18

See application file for complete search history.

(56) References Cited

U.S. PATENT DOCUMENTS

| | | | | |
|---|---|---|---|---|
| 4,898,544 | A * | 2/1990 | Callahan | 439/498 |
| 6,206,507 | B1 * | 3/2001 | Hino | 347/50 |
| 6,723,925 | B2 * | 4/2004 | Ohara et al. | 174/113 R |
| 7,258,423 | B2 * | 8/2007 | Nakamura | 347/50 |
| 7,695,115 | B2 | 4/2010 | Akahane | |
| 2010/0171794 | A1 * | 7/2010 | Miyata et al. | 347/50 |
| 2011/0279499 | A1 | 11/2011 | Kemma et al. | |

FOREIGN PATENT DOCUMENTS

| | | |
|---|---|---|
| JP | 2008-231779 | 9/2006 |
| JP | 4245034 | 3/2009 |
| JP | 2010-27762 | 2/2010 |
| JP | 2011-235560 | 11/2011 |

* cited by examiner

*Primary Examiner* — Stephen Meier
*Assistant Examiner* — Renee I Wilson
(74) *Attorney, Agent, or Firm* — Cooper & Dunham LLP

(57) ABSTRACT

A liquid discharge head includes a pressure generation part generating pressure to discharge a liquid droplet; and a flexible wiring member connected with the pressure generation part. The flexible wiring member includes a first flexible cable and a second flexible cable which are joined. One end part of the first flexible cable is connected with the pressure generation part, and the other end part of the first flexible cable is joined with one end part of the second flexible cable. The second flexible cable is folded to have a plane part perpendicular to a joint area between the first flexible cable and the second flexible cable and extending in a direction away from the first flexible cable, and the plane part is deformed in response to force applied from a part on which the other end part of the second flexible cable is mounted.

6 Claims, 26 Drawing Sheets

LIQUID DISCHARGE HEAD AND IMAGE FORMING APPARATUS

BACKGROUND OF THE INVENTION

1. Field of the Invention

The present invention relates to a liquid discharge head and an image forming apparatus.

2. Description of the Related Art

As an image forming apparatus such as a printer, a facsimile machine, a copier, a plotter, a multifunction peripheral that includes the respective functions thereof or the like, an inkjet recording apparatus or the like is known as an image forming apparatus of a liquid discharge recording type using a recording head that includes a liquid discharge head discharging a liquid droplet (liquid droplet discharge head), for example.

As the liquid discharge head, there is one using piezoelectric actuators, for example. In the liquid discharge head using piezoelectric actuators, vibration plate members, which form parts of walls of plural pressure generation chambers individually corresponding to plural nozzles which discharge liquid droplets and are arranged in parallel, are deformed by piezoelectric elements (piezoelectric members), the volumes of the respective pressure generation chambers are changed, and liquid droplets are discharged.

In a case of using such piezoelectric actuators, an electrode of each one of the piezoelectric elements is connected with a relay substrate of a carriage via a flexible printed circuit (simply referred to as "FPC", hereinafter) on which a driving circuit (driver IC) is mounted and a flexible flat cable (simply referred to as "FFC", hereinafter) (see Japanese Laid-Open Patent Application No. 2011-235560 (Patent reference No. 1)). In this case, a FFC is used to connect the relay substrate of the carriage and a control substrate on which a control part of an apparatus body side is mounted. Thus, signal transfers are achieved for controlling the deformation of the piezoelectric elements for the respective pressure generation chambers by the control part.

Further, as a structure of connecting a FPC and a FFC, for example, it is known to reinforce a solder joint part between the FPC and the FFC by an insulating film for the purpose of positively preventing a circuit pattern near the connection from being disconnected in a case where bending stress is applied near the connection (see Japanese Laid-Open Patent Application No. 2010-027762 (Patent reference No. 2)).

As discussed in Patent reference No. 1, a FFC as a flexible wiring member connecting a liquid discharge head and a relay substrate has flexibility, and thus, it is possible to relatively easily make a layout in a limited narrow space in the carriage by warping or bending it.

However, the FFC receives stress upon being connected with the relay substrate, and also, constantly receives reaction force from the connection (mounting point) even in a connected state in a case where a difference exists between the distance between the head and the connection (mounting point) and the length of the FFC because the length of the FFC may have variation.

Thus, in a case of using as a flexible wiring member a member in which a FFC and a FPC of the side of a head are connected, stress may be applied to a joint between the FFC and the FPC, and damage or a disconnection may occur as a result of cracking occurring near the joint end.

SUMMARY OF THE INVENTION

In an embodiment, a liquid discharge head includes a pressure generation part that generates pressure to discharge a liquid droplet; and a flexible wiring member connected with the pressure generation part. The flexible wiring member includes a first flexible cable and a second flexible cable which are joined and connected. One end part of the first flexible cable is connected with the pressure generation part, and the other end part of the first flexible cable is joined with one end part of the second flexible cable. The second flexible cable is folded to have a state of having a plane part that is perpendicular to a joint area between the first flexible cable and the second flexible cable and extends in a direction of getting away from the first flexible cable. The plane part is deformed in response to force applied from a part on which the other end part of the second flexible cable is mounted.

Other objects, features and advantages of the present invention will become more apparent from the following detailed description when read in conjunction with the accompanying drawings.

DETAILED DESCRIPTION OF THE EMBODIMENTS

Below, using accompanying drawings, the embodiments will be described. First, using FIG. 1, one example of an image forming apparatus that includes a liquid discharge head according to the embodiments will be described.

Figure 1:
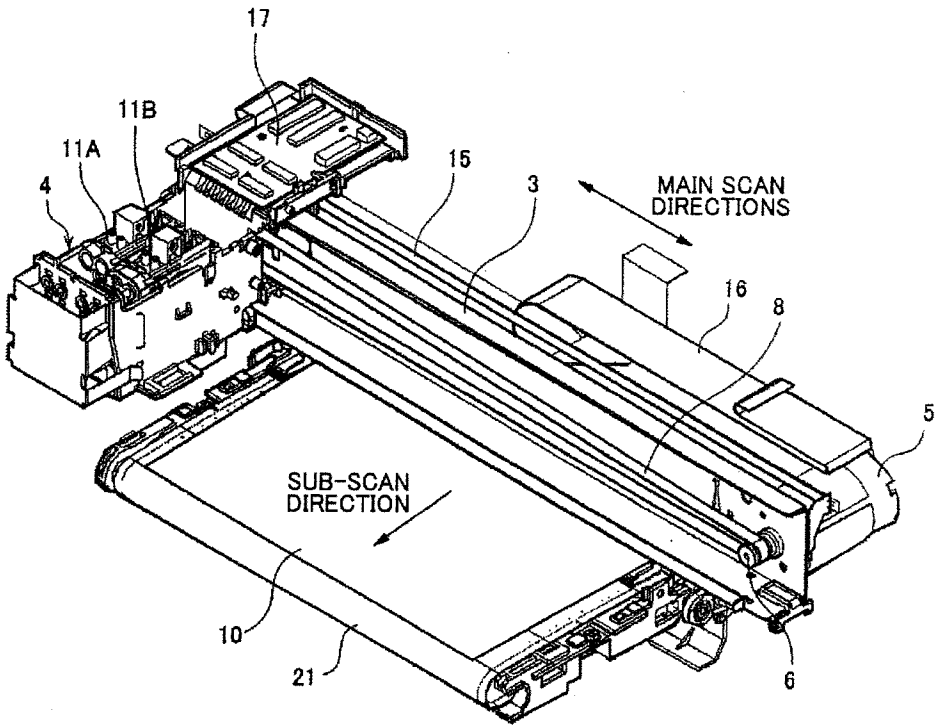
FIG. 1 shows a perspective view of one example of a mechanism part of an image forming apparatus according to embodiments.

In the image forming apparatus of FIG. 1, a guide member 3 made of a plate-like member supports a carriage 4 in such a manner that the carriage 4 can move in main scan directions. The carriage 4 is moved in the main scan directions and carries out scanning operations as a result of being driven by a main scan motor 5 via a timing belt 8 that is wound between a driving pulley 6 and a driven pulley (not shown) in a state of being strained therebetween.

In the carriage 4, recording heads 11A and 11B (simply referred to as "recording heads 11" hereinafter when 11A and 11B are not distinguished) are arranged in such a manner that nozzle rows each one of which has plural nozzles are arranged and mounted in a sub-scan direction perpendicular to the main scan directions and liquid discharge direction thereof faces downward. The recording heads 11 are liquid discharge head units where the liquid discharge heads and head tanks are integrally included, respectively. The liquid discharge heads act as image forming parts and discharge liquid droplets of respective colors, i.e., yellow (Y), cyan (C), magenta (M) and black (K).

The recording heads 11 have two nozzle rows per each one of the recording heads 11, and the respective colors, i.e., Y, M, C and K are allocated to these total four nozzle rows for discharging liquid droplets of the corresponding colors.

To the head tanks of the recording heads 11, inks of the desired colors are supplied via supply tubes from liquid cartridges (not shown, main tanks, referred to as "ink cartridges" hereinafter) of the apparatus body side.

Further, an encoder scale 15 is placed along the main scan directions of the carriage 4, and an encoder sensor (not shown) made of a transmission-type photosensor for reading the scale (position identification part) of the encoder scale 15 is mounted on the carriage 4 side.

On the carriage 4, a carriage-side substrate (hereinafter, referred to as a "relay substrate") 17 is mounted, which is connected with a control substrate on which a control part of the apparatus body is mounted via a FFC 16. On the relay substrate 17, the above-mentioned encoder sensor and a circuit are mounted, which circuit is used to carry out signal transfer with a driving circuit (driver IC) of the recording head 11 side. The relay substrate 17 and the recording heads 11 are connected via flexible wiring members 30, as will be described later.

On the lower side of the carriage 4, a conveyance belt 21 as a conveyance part for conveying a paper sheet 10 in the sub-scan direction is placed. The conveyance belt 21 is an endless belt, is wound between a conveyance roller and a tension roller, and is driven to draw a loop extending along the sub-scan direction as a result of the conveyance roller being driven and rotated by a sub-scan motor (not shown) via a timing belt and a timing pulley.

In the image forming apparatus configured as described above, the supplied paper sheet 10 is intermittently conveyed by the conveyance belt 21, and the recording heads 11 are driven according to an image signal while the carriage 4 is being moved in the main scan directions. Thus, liquid droplets are discharged onto the paper sheet 10 that is at a stop so that a line of an image is recorded. Then the paper sheet 10 is conveyed by a predetermined amount, the subsequent line of an image is recorded. These operations of recording the subsequent line of an image are repeated and thus an image is recorded on the paper sheet 10. Thereafter, the paper sheet 10 on which the image is thus formed is ejected.

Figure 2:
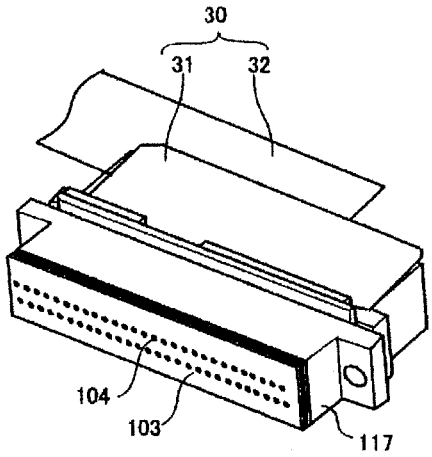
FIG. 2 shows a perspective view of an exterior appearance of one example of a liquid discharge head.

Next, one example of the liquid discharge head included in the recording head 11 of the image forming apparatus will be described using FIGS. 2 and 3.

Figure 3:
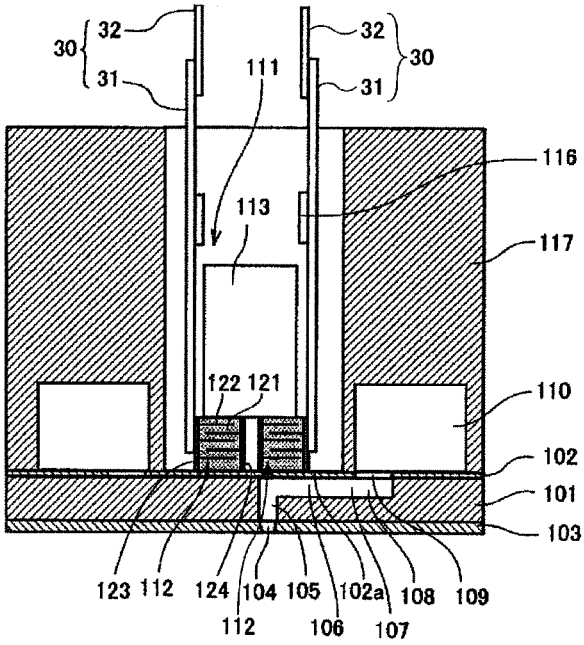
FIG. 3 shows a sectional view of the liquid discharge head taken along a longitudinal direction of an individual liquid chamber.

The liquid discharge head has a flow passage plate (which may also be called a flow passage substrate, a liquid chamber substrate or the like) 101, a vibration plate member 102 and a nozzle plate 103, as shown in FIG. 3. The vibration plate member 102 is joined onto the top surface of the flow passage plate 101 and acts as a vibration plate. The nozzle plate 103 is joined onto the bottom surface of the flow passage plate 101.

Thereby, plural individual liquid chambers (also called pressurized liquid chambers, pressure chambers, pressurized chambers, flow passages or the like, and hereinafter, simply referred to as "liquid chambers") 106, fluid resistance parts 107 and liquid introduction parts 108 are formed. The plural liquid chambers 106 act as individual flow passages communicating with the plural nozzles 104 that discharge liquid droplets via respective passages 105. The fluid resistance parts 107 also act as supply paths that supply ink to the liquid chambers 106. The liquid introduction parts 108 communicate with the liquid chambers 106 via the fluid resistance parts 107.

The ink is supplied to the liquid chambers 106 via the liquid introduction parts 108 and the fluid resistance parts 107 via supply ports 109 formed in the vibration plate member 102 from a common liquid chambers 110 formed in a frame member 117 described later.

The vibration plate member 102 serves as walls of the liquid chambers 106, the fluid resistance parts 107, the liquid introduction parts 108 and so forth. Outside vibration areas 102*a* of the vibration plate member 102 (on the side opposite to the liquid chambers 106), a piezoelectric actuator 111 is placed. The piezoelectric actuator 111 includes electromechanical transduction elements as pressure generation parts (actuator parts or driving parts) deforming the vibration areas 102*a*.

The piezoelectric actuator 111 has two stacked piezoelectric members 112 joined onto a base member 113 by adhesive. In each one of the piezoelectric members 112, desired number of columnar piezoelectric members (called "piezoelectric columns") are formed in the form of a comb at predetermined intervals through a groove forming process by half-cut dicing. At this time, the desired number of piezoelectric columns formed like a comb are arranged to be aligned in the direction perpendicular to FIG. 3.

In the piezoelectric member 112, piezoelectric layers 121 and inner electrodes 122 are stacked alternately. The inner electrodes 122 are alternately extended out to respective end surfaces, i.e., side surfaces (surfaces along the stacked direction) approximately perpendicular to the vibration plate member 102, and are connected to end surface electrodes (outer electrodes) 123 and 124 formed on the side surfaces. The end surface electrodes 123 are individual external electrodes, and the end surface electrodes 124 are common external electrodes. By applying a voltage between the external electrode 123 and the external electrode 124, displacement occurs in the stacked direction.

Further, the flexible wiring members 30 are connected to the piezoelectric members 112 for applying driving signals.

Further, onto the outer sides of the piezoelectric actuator 111, the frame member 117 is joined which is made of a resin member such as epoxy resin or the like or a metal member such as SUS or the like.

In the frame member 117, the above-described common liquid chambers 110 are formed. Further, the supply ports (not shown) for supplying the ink to the common liquid chambers 110 from the outside are formed, and are connected with the above-mentioned head tank 202.

In the thus configured liquid discharge head, the piezoelectric column shrinks as a result of the voltage applied to each piezoelectric column of the piezoelectric member 112 being reduced from a reference electric potential, the vibration area 102*a* of the vibration plate member 102 deforms and the volume of the liquid chamber 106 increases. Thus, the ink flows into the liquid chamber 106. Thereafter, the voltage applied to the piezoelectric column is increased from the reference electric potential, the piezoelectric column is thus extended in the stacked direction, the vibration area 102*a* of the vibration plate member 102 is deformed and the volume of the liquid chamber 106 is reduced. Thus, the liquid chamber 106 is pressurized, and a liquid droplet is discharged from the nozzle 104.

Then, as a result of the voltage being returned to the reference electric potential, the vibration area 102*a* of the vibration plate member 102 is restored to the initial position, the liquid chamber 106 expands and negative pressure is generated. At this time, the liquid chamber 106 is filled with the ink from the common liquid chamber 110. Then, after the vibration of the meniscus surface of the nozzle 104 attenuates and stabilizes, operations for subsequent liquid droplet discharge are proceeded to.

It is noted that the liquid discharge head can be driven not only in the above-described pull-push discharge method but also a pull discharge method, a push discharge method or the like. The pull discharge method is a method in which the vibration plate member is released from a state of being pulled, and pressurization is carried out by restoration force. The push discharge method is a method in which the vibration plate member is pushed from the initial position.

Figure 4:
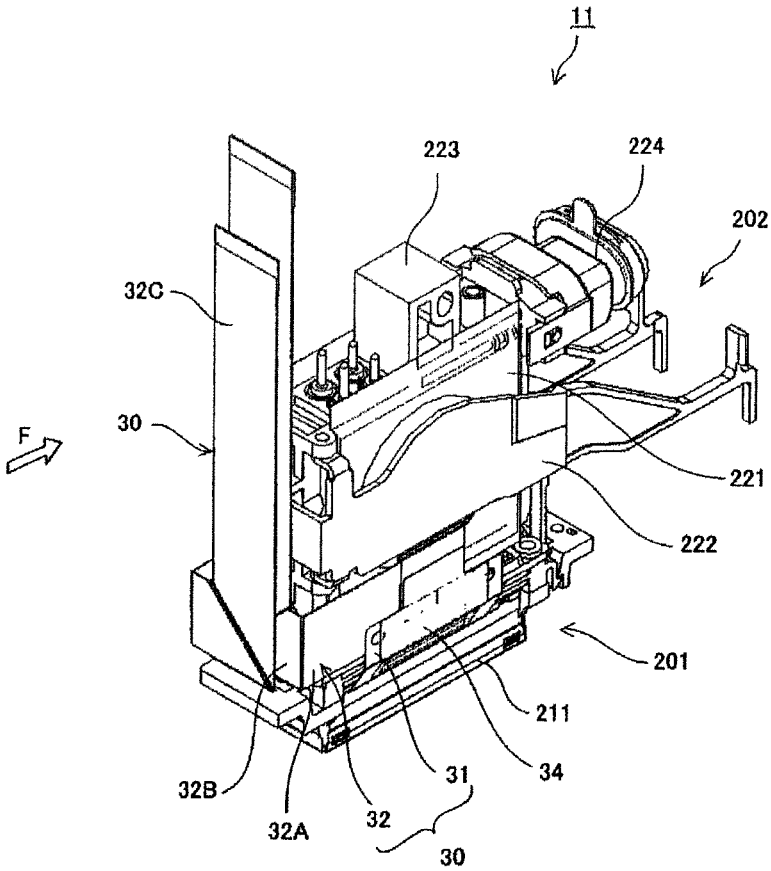
FIG. 4 shows a perspective view of an exterior appearance of a liquid discharge head unit including a liquid discharge head according to a first embodiment.
Figure 5:
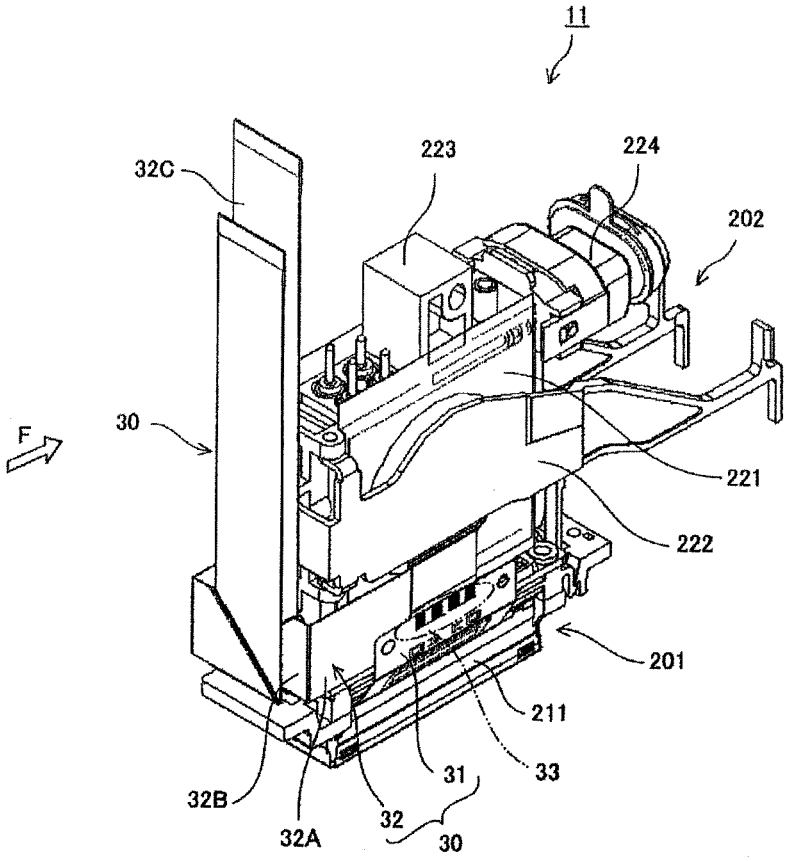
FIG. 5 shows a perspective view of an exterior appearance of FIG. 4 in a state of a reinforcement member having been removed.
Figure 6:
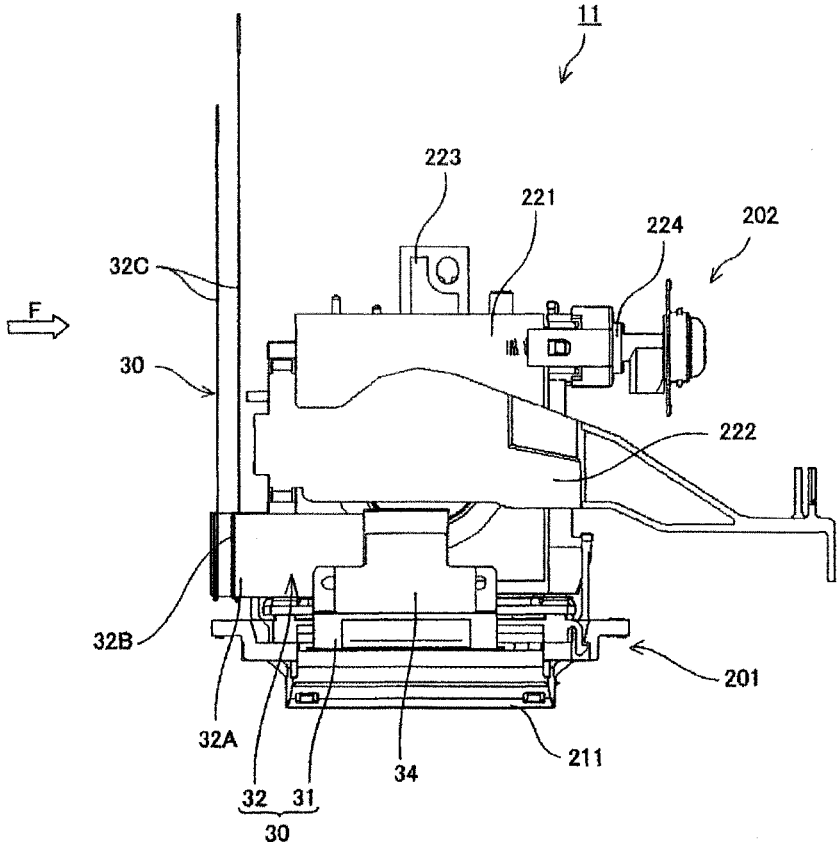
FIG. 6 shows a side view of the liquid discharge head unit.
Figure 7:
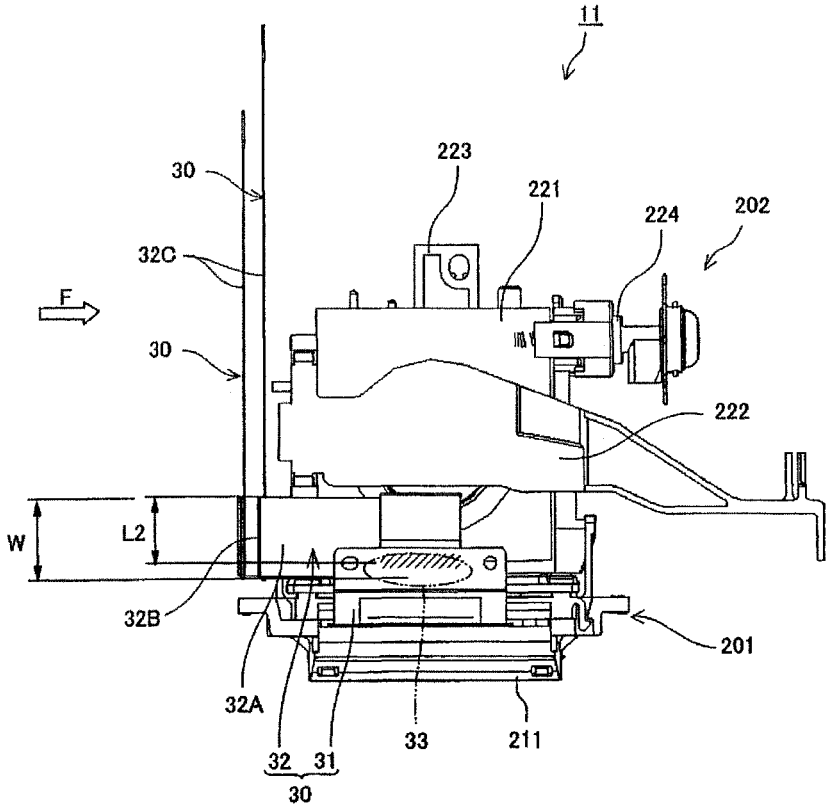
FIG. 7 shows a side view of FIG. 6 in a state of the reinforcement member having been removed.
Figure 8:
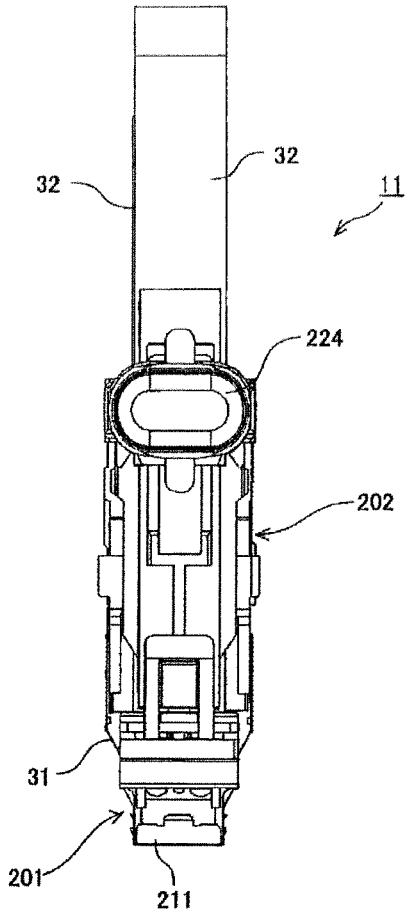
FIG. 8 shows a front view of the liquid discharge head unit.

Next, the liquid discharge head according to a first embodiment included in the recording head 11 of the image forming apparatus will be described using FIGS. 4 to 8. FIG. 4 shows a perspective view of an exterior appearance of a liquid discharge head unit including the liquid discharge head according to the first embodiment. FIG. 5 shows a perspective view of an exterior appearance of FIG. 4 in a state of a reinforcement member having been removed. FIG. 6 shows a side view of the liquid discharge head unit. FIG. 7 shows a side view of FIG. 6 in a state of the reinforcement member having been removed. FIG. 8 shows a front view of the liquid discharge head unit.

In this liquid discharge head unit (recording head 11), a liquid discharge head 201 and a head tank 202 that supplies the ink to the liquid discharge head 201, such as those described above, are integrated.

As described above, the liquid discharge head 201 has a head part 211 that has pressure generation parts (the above-described piezoelectric members 112) inside, and flexible wiring members 30 that are connected with the pressure generation parts (the piezoelectric members 112 in the first embodiment) that are inside the head part 211. As described above, the two flexible wiring members 30 are extended out from the corresponding piezoelectric members 112 of the head part 211, respectively.

The head tank 202 has a tank body 221, a displacement member 222, a liquid supply port part 223 and an opening-to-atmosphere mechanism 224. The tank body 221 includes a container part that contains the liquid to be supplied to the liquid discharge head 201. The displacement member 222 is such as a filler and changes in its position according to the remaining amount of the liquid in the tank body 221. The liquid supply port part 223 is used to supply the liquid to the tank body 221 from the outside. The opening-to-atmosphere mechanism 224 opens the inside of the tank body 221 to the atmosphere.

Next, a configuration of and how to lay the flexible wiring members 30 will be described.

Each one of the flexible wiring members 30 is a member obtained from connecting a FPC 31 that is a first flexible cable and a FFC 32 that is a second flexible cable as a result of joining respective wiring electrodes thereof (not shown). The FPC 31 is a belt-like sheet member configured by a wiring electrode layer and an insulating layer. For example, the FPC 31 is first pulled out from a roll base material in one direction, then is joined with the FFC 32, and is cut to have a desired length.

One end part of the FPC 31 is connected to the external electrodes 123 of the piezoelectric member 112 that is the pressure generation part of the head part 211, and so forth. Generally speaking, micro wiring can be carried out on a flexible printed circuit (FPC) in which copper wiring is fabricated on polyimide resin, and it is possible to place an IC or the like on the FPC. Thus, a FPC is used at the side connected with the piezoelectric member 112.

One end part of the FFC 32 is connected with the other end part of the FPC 31. The other end part of the FFC 32 is connected (mounted) to the relay substrate 17 or the like mounted on the carriage 4. The connection (mounting) of the other end part of the FFC 32 may be carried out using a connector (not shown) or the like provided therefor. Alternatively, the connection (mounting) of the other end part of the FFC 32 may be carried out directly without using a connector or the like.

It is also possible to form the flexible wiring member integrally. However, a FPC in which micro wiring can be made may be very expensive, and the price of a FPC may increase approximately in proportion to the area of the FPC. Thus, if a FPC is used to reach the relay substrate 17 throughout, the cost may increase. This is the reason why the above-mentioned connected structure is employed.

It is noted that a protective film 34 as a reinforcement member is provided for protecting a joint part (joint) 33 between the FPC 31 and the FFC 32.

The FFC 32 has a first part 32A, a second part 32B and a third part 32C. The first part 32A is obtained as a result of the one end part of the side of the FPC 31 being folded, thus a folded part 321 (described later) being formed there, and the one end part being extended along the longitudinal direction of the head part 211. The second part 32B is obtained as a result of the end part of the first part 32A of the side of the longitudinal direction end part of the head part 211 being folded to face the longitudinal direction end part of the head part 211. The third part 32C is obtained as a result of being folded from the second part 32B, and extending upward along the end part of the head tank 202. The third part 32C of the FFC 32 acts as a plane part (facing part) that faces the direction of force F applied by the part on which the other end part of the FFC 32 is mounted or the like.

The two FFCs 32 of the two flexible wiring members 30 connected with the corresponding piezoelectric members 112 are placed along the longitudinal direction end part of the head tank 202 in such a manner that at least parts thereof overlap when viewed in the direction in which the force F is applied to the respective second parts 32B.

Thus, when the force F is applied to the FFC 32 from the part on which the other end parts thereof (the extending end parts of the third parts 32C) are mounted or the like, the third parts 32C deform accordingly. Thus, a load such as stress being applied to the joint parts 33 between the FPCs 31 and the FFCs 32 is reduced, and damage or the like of the joint parts 33 is prevented.

In order that the force F is absorbed by the deformation, it is preferable that the parts at which the two FFCs 32 overlap are arranged in such a manner that such a distance is kept therebetween that these parts can freely deform independently. Further, in order to strengthen the rigidity near the joint parts 33, the second parts 32B may be superposed and in contact with one another while the third parts 32C are arranged in such a manner that such a distance is kept therebetween that these parts can freely deform independently. Further, the second parts 32B may be fixed together by adhesive or the like.

Figure 23:
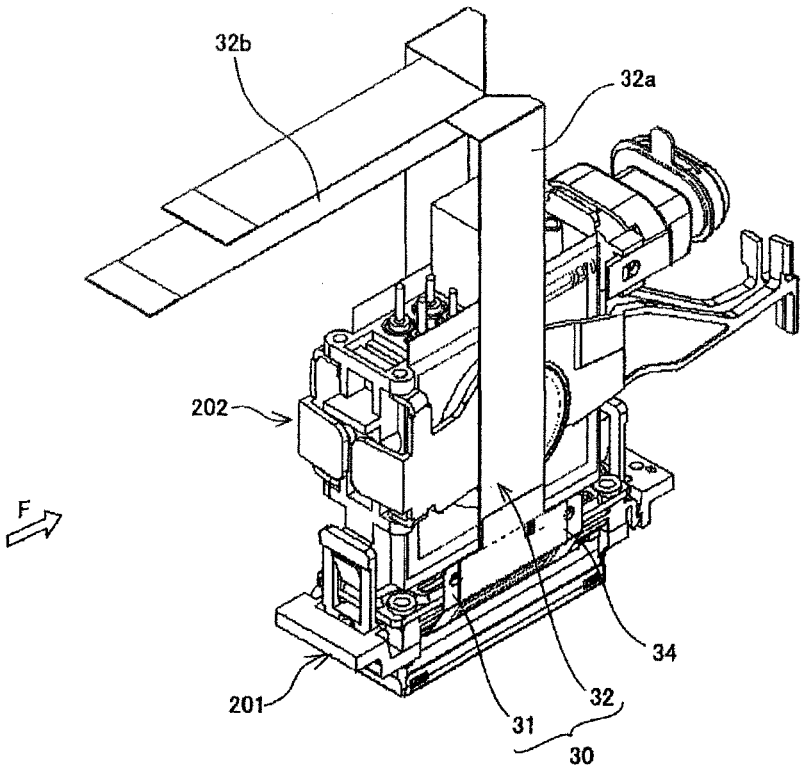
FIG. 23 shows a perspective view of an exterior appearance of a liquid discharge head unit including a liquid discharge head of a comparison example.
Figure 24:
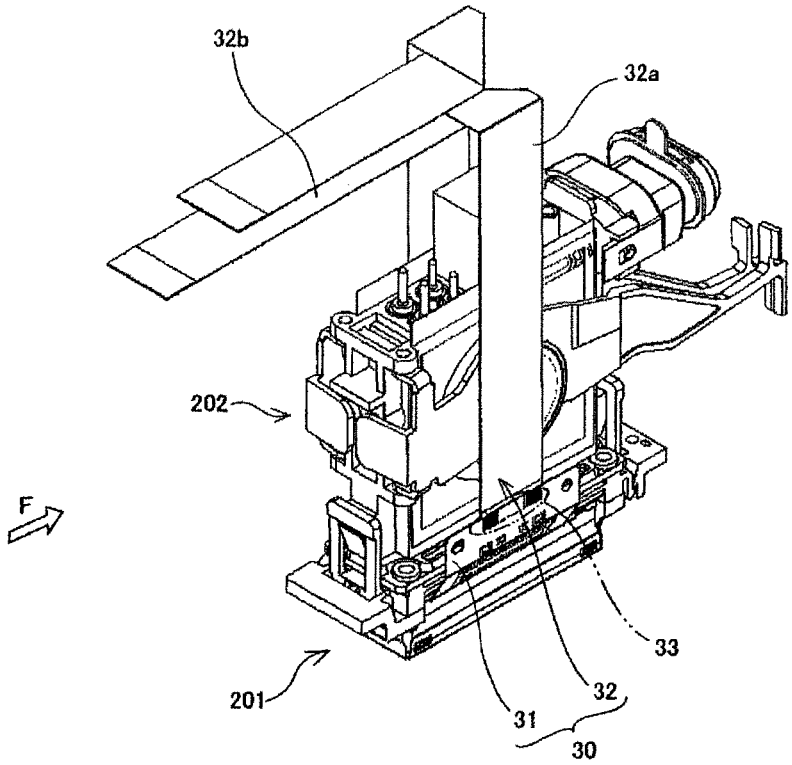
FIG. 24 shows a perspective view of an exterior appearance of FIG. 23 in a state of a reinforcement member having been removed.
Figure 25:
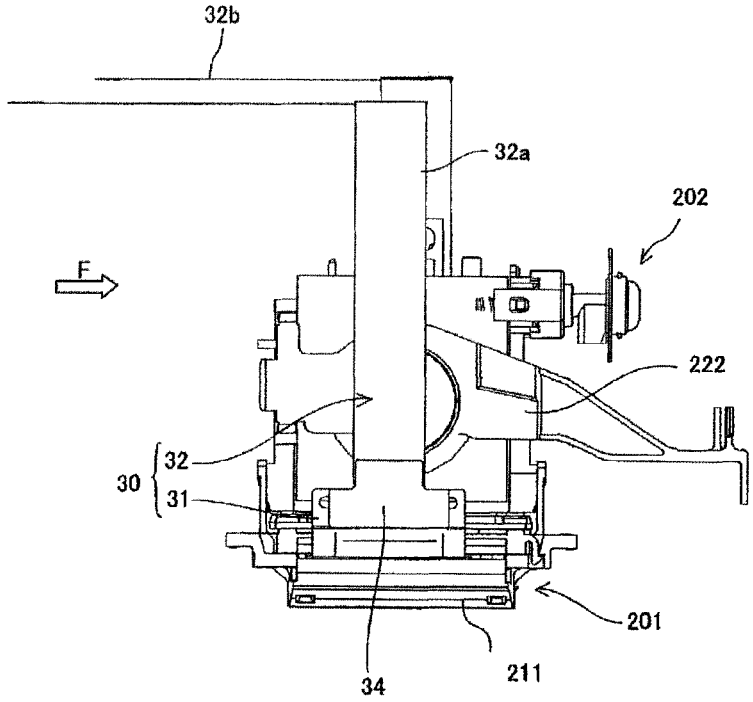
FIG. 25 shows a side view of the liquid discharge head unit of the comparison example.
Figure 26:
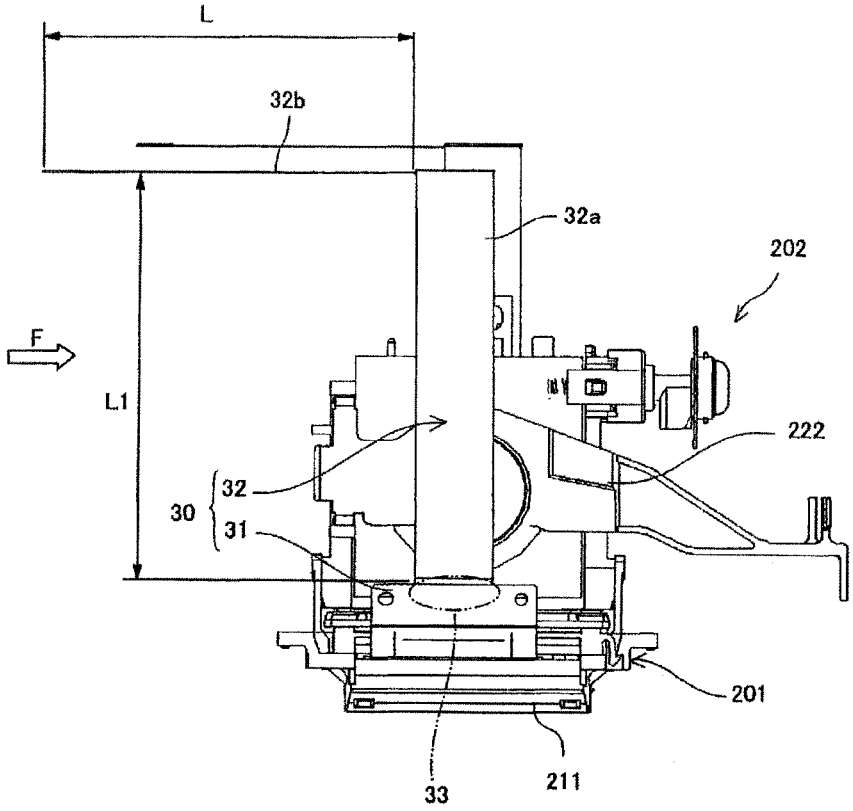
FIG. 26 shows a side view of FIG. 25 in a state of the reinforcement member having been removed.
Figure 27:
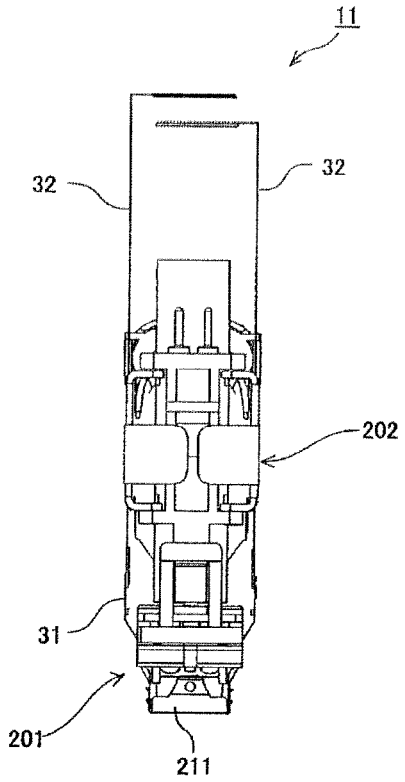
FIG. 27 shows a front view of the liquid discharge head unit of the comparison example.

This point will be described in comparison with a liquid discharge head of a comparison example shown in FIGS. 23 to 27. FIG. 23 shows a perspective view of an exterior appearance of a liquid discharge head unit including the liquid discharge head of the comparison example. FIG. 24 shows a perspective view of an exterior appearance of FIG. 23 in a state of a reinforcement member having been removed. FIG. 25 shows a side view of the liquid discharge head unit of the comparison example. FIG. 26 shows a side view of FIG. 25 in a state of the reinforcement member having been removed. FIG. 27 shows a front view of the liquid discharge head unit of the comparison example. The same reference numerals are given to parts corresponding to those of the first embodiment.

In this comparison example, in a FFC 32, a first part 32*a* is directly extended just upward (in a direction perpendicular to the longitudinal direction of a head part 211 and a direction along an outer surface of a head tank 202) from a FPC 31. Then, the FFC 32 is folded in the longitudinal direction of the head part 211 above the head part 211 and thus a second part 32*b* is formed. Then, the extending end of the second part 32*b* is connected to the connector of the relay substrate 17.

In the configuration of this comparison example, when the FFC 32 of the liquid discharge head is connected to the relay substrate 17 of the carriage 4, an assembling worker carries out the work while grasping the FFC 32. As a result of the worker thus carrying out the work while grasping the FFC 32, the force F in the direction of the arrow shown in FIG. 25 and so forth is applied to the FFC 32 at a time of the connection.

The second part 32*b* of the FFC 32 is manufactured in such a manner that the length L (see FIG. 26) thereof is made slightly greater than the distance to the connection to the relay substrate 17 in consideration of component tolerance and assembly workability. Thus, some slack occurs in the FFC 32 after the completion of the connection to the relay substrate 17. By this slack, the force F as reaction force is applied to the FFC 32. The direction of the force F against the FFC 32 is the direction of the arrow of FIG. 25 the same as that of the time of assembling work.

At this time, at the first part 32*a* of the FFC 32, this part is placed in parallel to the direction in which the force F is applied, and the direction of the width of the FFC 32 is the same as the direction in which the force F is applied. As a result, the first part 32*a* hardly deforms with respect to the direction of the force F.

When "F" denotes the force as reaction force generated during the assembly and after the assembly and "L1" denotes the distance between the point of action of the force F and the joint part 33 between the FPC 31 and the FFC 32, as shown in FIG. 26, the first moment of force M1 (=F×L1) is applied to the FFC 32, where the joint part 33 acts as the fulcrum.

As a result, the joint part 33 between the FFC 32 and the FPC 31 may be damaged and disconnected.

In contrast thereto, according to the first embodiment, as shown in FIG. 7, the third part 32C of the FFC 32 acts as a surface (plane) facing the direction in which the force F is applied (facing surface (plane)) and can easily deform when the force F is applied.

When "F'" denotes the force as reaction force generated during the assembly and after the assembly and applied to the top part of the second part 32B and "L2" denotes the distance between the point of action of the force F' and the part 33 between the FPC 31 and the FFC 32, the second moment of force "M2" (=F'×L2) is applied to the FFC 32 where the joint part 33 acts as the fulcrum.

When the second moment of force M2 is compared with the above-mentioned first moment of force M1 of the comparison example, even if the same force F is applied, the distances between the point of action of the force F and the joint part 33 between the FFC 32 and the FPC 31 are different, as L1>L2. Thus, M1>M2 is obtained, and it can be seen that the moment of force generated is smaller in the first embodiment.

Further, as to the force F, since the force is absorbed as a result of the third part 32C deforming, the actually applied force "F'" becomes considerably smaller than "F". That is, the applied force is smaller and also the distance of the moment of force is less in the first embodiment. Thus, according to the first embodiment, almost no force is applied to the joint part 33 between the FFC 32 and the FPC 31, and likelihood of the joint part 33 being damaged and disconnected is reduced.

Figure 9:
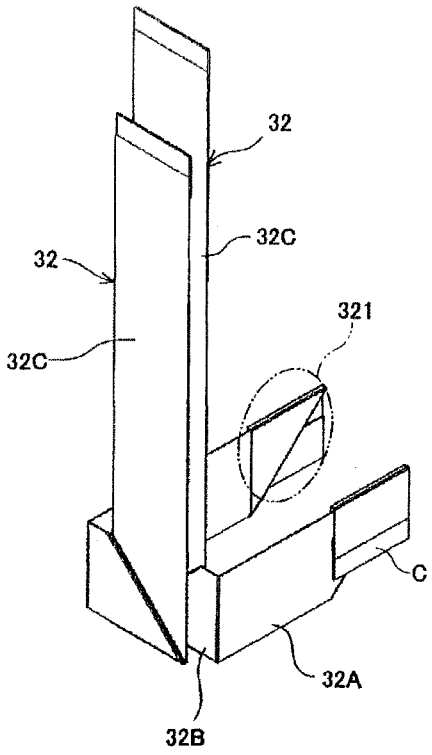
FIG. 9 shows a perspective view for illustrating a folded part of a FFC.

Next, the folded part 321 of the FFC 32 will be described using FIG. 9. FIG. 9 shows a perspective view for illustrating the folded part 321 of the FFC 32.

The folded part 321 is formed at the one end part of the FFC 32 at which the FFC 32 is connected with the FPC 31, and the first part 32A is extended out in the longitudinal direction of the head part 211. It is noted that the folded part 321 of the FFC 32 is such that the one end part of the FFC 32 is folded at one side of the FPC 31 to cover the joint part 33 between the FFC 32 and the FPC 31 from the one side of the FPC 31.

Figure 10:
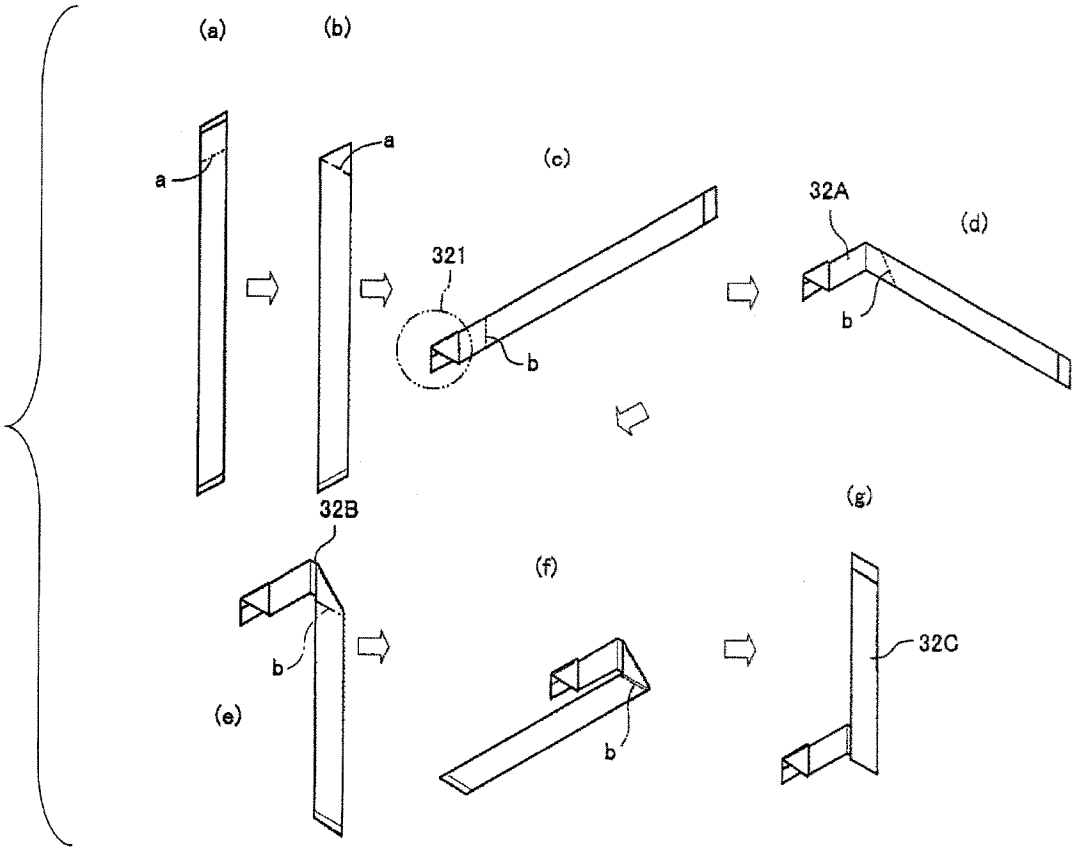
FIG. 10 illustrates a procedure of folding the FFC.

The FFC 32 has the sheet-like form, thus a folding process can be carried out thereon, and it is possible to realize a desired layout within a limited space as shown in FIG. 10. By thus carrying out the folding process on the part immediately adjacent to the joint part 33 between the FFC 32 and the FPC 31, it is possible to reduce the moment applied to the joint part 33. Thus, it is possible to improve the reliability of the joint part 33, and optimize the layout of the FFC 32.

As a comparison example, a configuration may be considered in which the FFC 32 has a divided configuration and the divided parts are connected by a connector(s) for carrying out the L-shape or crank-shape layout of the FFC 32 without thus carrying out the folding process. However, in such a configuration of the comparison example, the cost may increase, and also, the assembly labor-hours may increase because of the connecting work.

Further, by thus forming the folded part 321 at the part immediately adjacent to the joint part 33 between the FFC 32 and the FPC 31, at least a part of the joint part 33 is included in the area at which the FPC 31 faces the FFC 32. Specifically, as shown in FIG. 7, when viewed from the direction of joining the FPC 31 and the FFC 32, at least the part (hatched part) of the joint part 33 is included in the width W of the FFC 32.

Thus, as described above, it is possible to reduce the moment of force applied by the force F to the joint part 33.

Next, folding procedures of the FFC 32 in the first embodiment will be described using FIG. 10. In FIG. 10, "a" denotes a mountain fold and "b" denotes a valley fold. It is noted that in the description of processing the FFC 32, the verb "fold" is used for calling a process of forming an angular shape from a flat shape without regard to the specific angle of the thus formed angular shape.

After the end part of the joint side (between the FFC 32 and the FPC 31) is folded in a mountain fold at the alternate long and short dash line "a" of FIG. 10 (*a*), the end part of the joint side is folded in a mountain fold at the broken line "a" of FIG. 10 (*b*). Thus, the folded part 321 is formed (the folded part 321 will be described in more detail later using FIG. 11) at the joint part 33 between the FFC 32 and the FPC 31 as shown in FIG. 10 (*c*). At this time, in the joint part 33 between the FFC 32 and the FPC 31, the one end part of the FFC 32 is folded at the one side of the FPC 31. In this configuration, in the state of the folded part 321 being placed at the one side of the FPC 31, a part "C" (see FIG. 9) at which the FFC 32 is connected with the FPC 31 faces the FPC 31.

The FFC 32 is then extended in the longitudinal direction of the head part 211. Then, as shown in FIG. 10 (*c*), the FFC 32 is folded in a valley fold at the alternate long and short dash line "b" so that the first part 32A is formed as shown in FIG. 10 (*d*) and the FFC 32 is thus folded in the direction along the longitudinal direction end part of the head part 211. Then, the FFC 32 is folded in a valley fold at the alternate long and short dash line "b" of FIG. 10 (*d*), and thus, the second part 328 is formed as shown in FIG. 10 (*e*). Next, the FFC 32 is folded in a valley fold at the respective alternate long and short dash lines "b" of FIG. 10 (*e*) and FIG. 10 (*f*). Thus, as shown in FIG. 10 (*g*), the third part 32C is formed which extends upward along the head tank 202 from the longitudinal direction end part of the head part 211.

Figure 11:
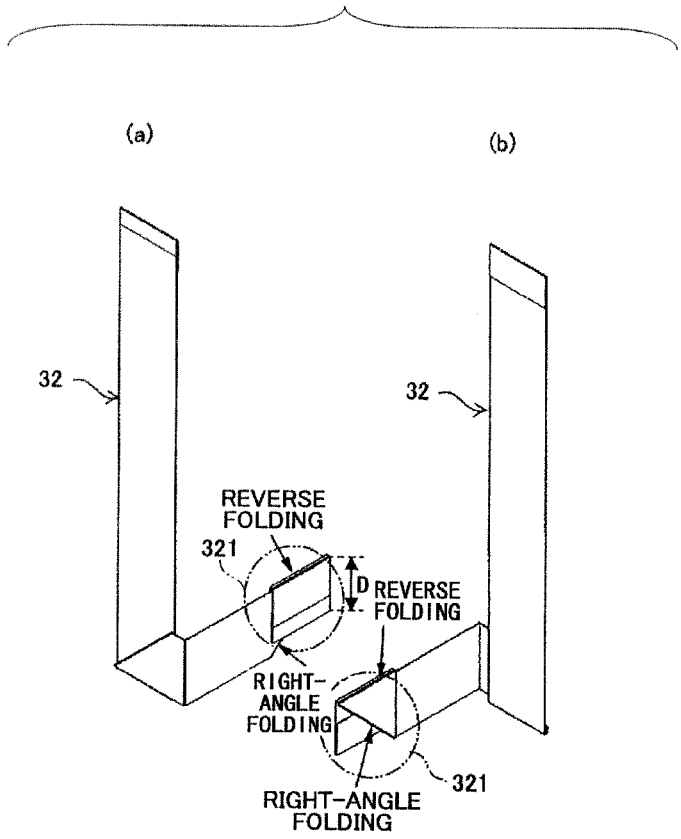
FIG. 11 illustrates the folded part of the FFC viewed from the front side and back side.

Next, different examples of the folded part of the FFC 32 will be described using FIGS. 11 and 12. FIG. 11 (*a*) and FIG. 12 (*a*) show perspective views viewed from the front side (the side of the joint plane (joint area) with the FPC 31). FIG. 11 (*b*) and FIG. 12 (*b*) show perspective views viewed from the back side.

The FFC 32 is placed in the limited space between the FPC 31 and the displacement member 222 of the head tank 202. In order to place the FFC 32 in such a narrow space, "right-angle folding" is carried out to change the direction of extending the FFC 32, and thereafter, "reverse folding" is carried out, as shown in FIG. 11. Thus, the layout of the FFC 32 in the height directions (the D directions in FIG. 11) is reduced so that it is possible to avoid an overlap with the displacement member 222.

The "right-angle folding" means a way of folding the FFC 32 using the fold formed when the FFC 32 has been folded in the mountain fold at the broken line "a" of FIG. 10 (*b*) such that the FFC 32 is turned over to change the direction of extending at a right angle. The "reverse folding" means a way of folding the FFC 32 using the fold formed when the FFC 32 has been folded in the mountain fold at the alternate long and short dash line "a" of FIG. 10 (*a*) such that the FFC 32 is turned over to reverse the direction of extending.

In the case of FIG. 11, the "reverse folding" is carried out in such a manner of folding the FFC 32 in such a direction to wrap around the part that has been folded in the "right-angle folding".

By thus carrying out folding, it is possible to hide the stacked part (obtained from these folding processes) of the FFC 32 from the outside. As a result of the stacked part of the FFC 32 being thus hidden from the outside, it is possible to prevent the stacked part from being accidentally caught by something while being handled in the assembly process of the FFC 32, for example. Further, during the transportation of the FFCs 32 alone, plurality of the FFCs 32 are packed in the form of being stacked together. Also in such a case, each one of the plural FFCs 32 can be prevented from lying on top of another at the respective stacked parts, and thus, handling thereof can be carried out more easily.

Further, in a case of further strengthening the folded state of the folded part 321, the stacked part of the folded part 321 is fixed by, for example, inserting a double-stick tape thereinto.

At this time, by employing the above-mentioned mode of the "reverse folding" to wrap around the "right-angle folded" part, it is sufficient that the fixing point for fixing the stacked part is only one point whereas the stacked part of the FFC 32 has the total three layers.

Figure 12:
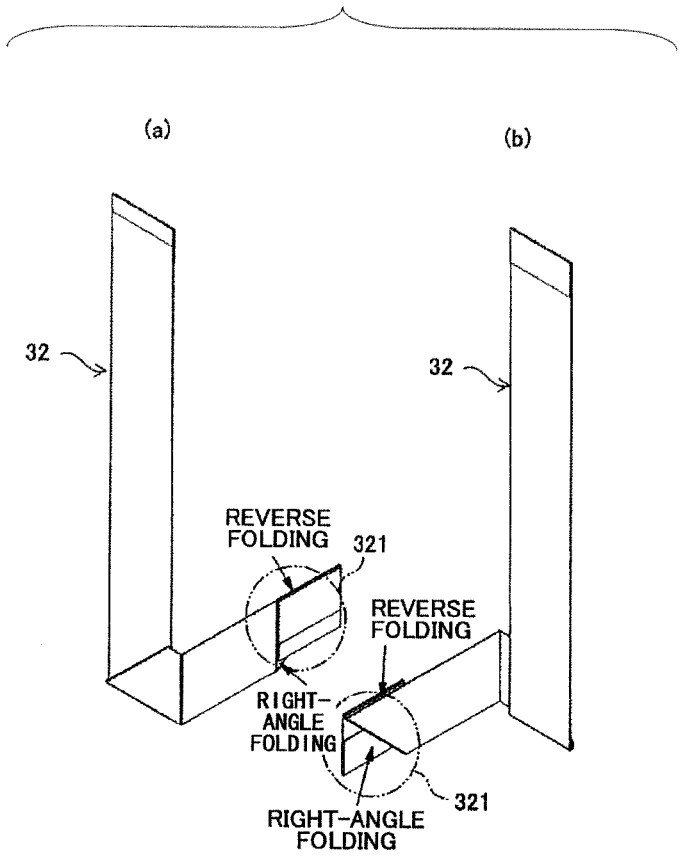
FIG. 12 illustrates another example of the folded part of the FFC viewed from front side and back side.

In contrast thereto, in a case of employing the mode of folding in such a manner that "reverse folding" does not wrap around the "right-angle folded" part as shown in FIG. 12, the number of fixing points for fixing the stacked part is two where the stacked part of the FFC 32 has the total three layers.

Thus, it is preferable to employ the mode of folding shown in FIG. 11 in such a manner that "reverse folding" wraps around the "right-angle folded" part, in order to improving handling ability and reducing the cost.

Figure 13:
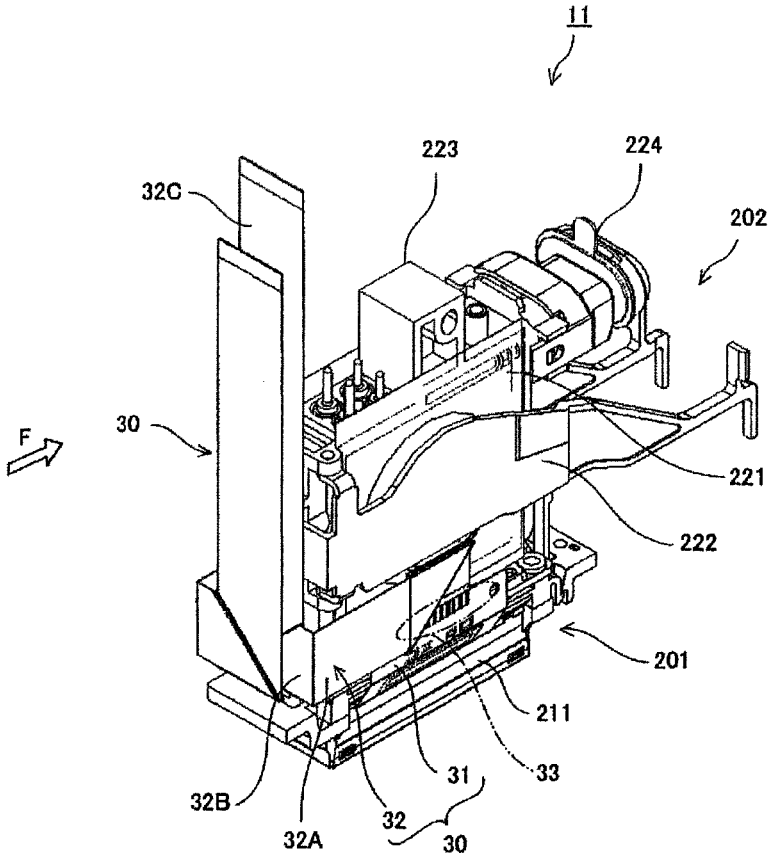
FIG. 13 shows a perspective view of an exterior appearance of a liquid discharge head unit including a liquid discharge head according to a second embodiment.
Figure 14:
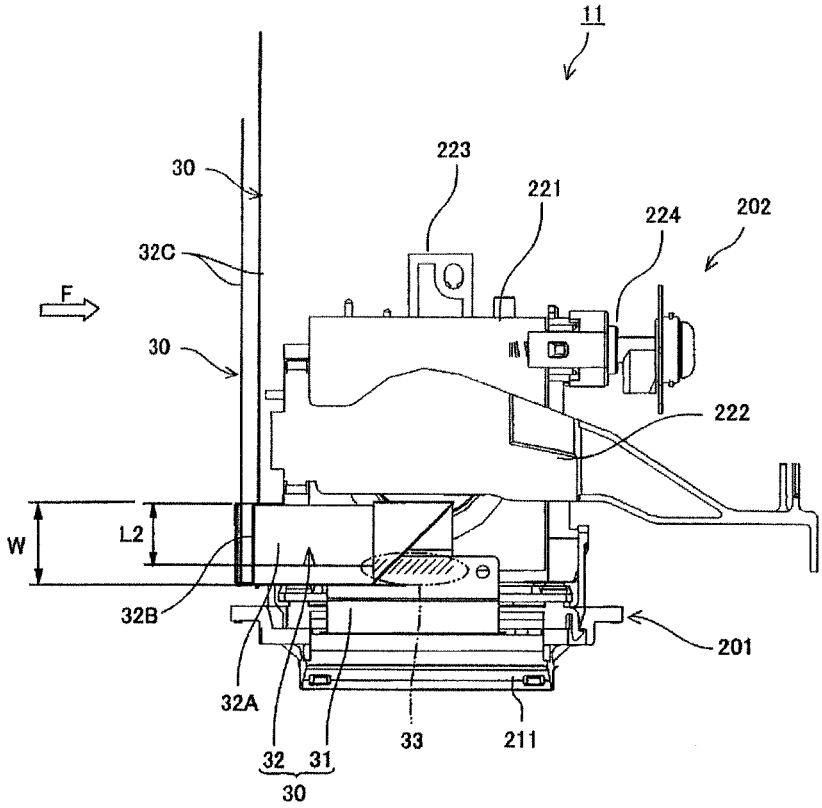
FIG. 14 shows a side view of the liquid discharge head unit according to the second embodiment.
Figure 15:
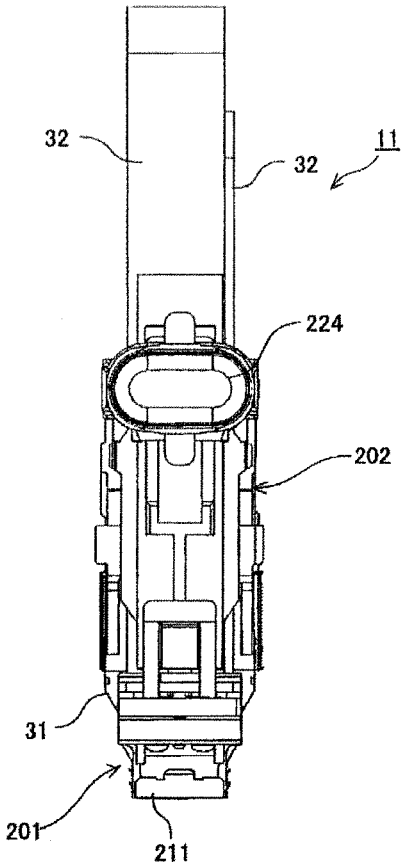
FIG. 15 shows a front view of the liquid discharge head unit according to the second embodiment.
Figure 16:
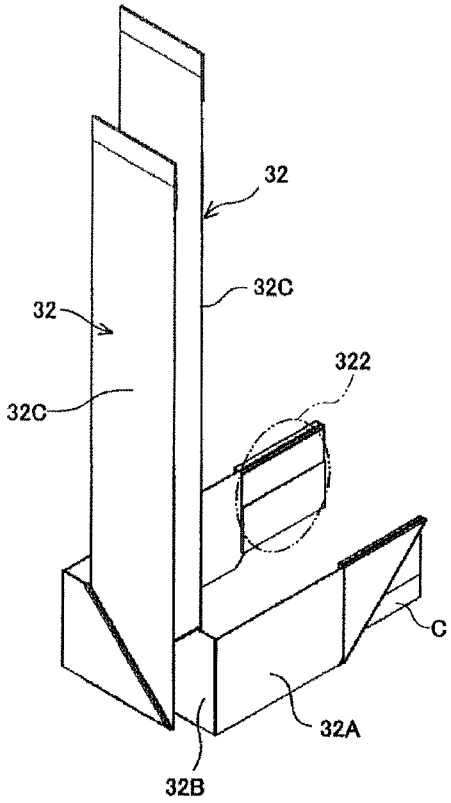
FIG. 16 shows a perspective view for illustrating a folded part of an FFC.

Next, a liquid discharge head according to a second embodiment will be described using FIGS. 13 to 16. FIG. 13 shows a perspective view of an exterior appearance of a liquid discharge head unit including the liquid discharge head according to the second embodiment. FIG. 14 shows a side view of the liquid discharge head unit according to the second embodiment. FIG. 15 shows a front view of the liquid discharge head unit according to the second embodiment. FIG. 16 shows a perspective view of an FFC.

The second embodiment is different from the first embodiment in that a folding configuration of a folded part 322 of a FFC 32 at a joint part between the FPC 31 and the FFC 32 is different.

That is, in this case, as shown in FIG. 16, the folded part 322 is formed at one end part of the FFC 32 which is connected with the FPC 31, and a first part 32A is extended in the longitudinal direction of the head part 211. This folded part 322 is such that the FFC 32 is folded to cover the joint part 33 to sandwich the FPC 31 from both sides.

As at this time, at least a part of the joint part 33 is included in the area at which the FPC 31 faces the FFC 32. Specifically, as shown in FIG. 14, when viewed from the direction of joining the FPC 31 and the FFC 32, at least a part (hatched part) of the joint part 33 is included in the width W of the FFC 32.

In the second embodiment, by thus sandwiching the FPC 31 by the folded part 322 of the FFC 32 at the joint part 33, it is possible to increase the strength of the joint part 33 in comparison to the first embodiment. Thus, damage or the like of the joint part 33 becomes unlikely to occur.

Figure 17:
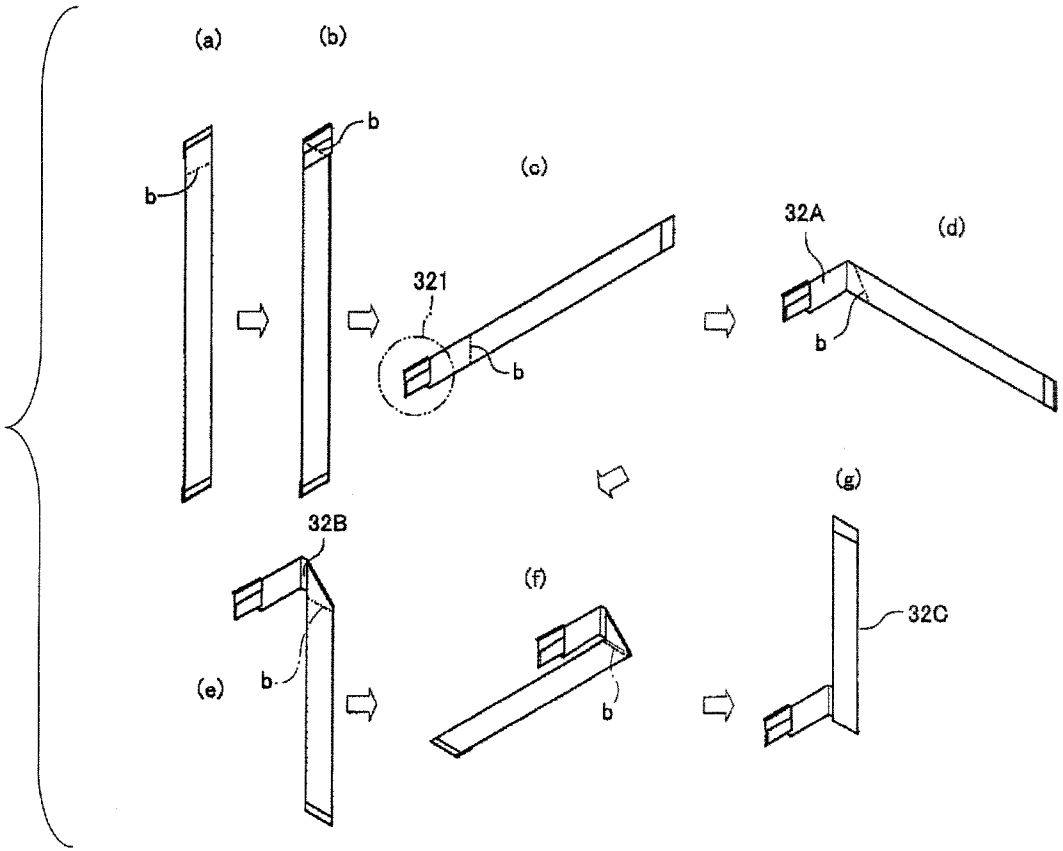
FIG. 17 illustrates a procedure of folding the FFC.

Next, folding procedures of the FFC 32 in the second embodiment will be described using FIG. 17. In FIG. 17, "b" denotes a valley fold.

After the end part of the joint side (between the FFC 32 and the FPC 31) is folded in a valley fold at the alternate long and short dash line "b" of FIG. 17 (*a*), the end part of the joint side is folded in a valley fold at the broken line "b" of FIG. 17 (*b*). Thus, the folded part 322 is formed at the joint part 33 between the FFC 32 and the FPC 31 as shown in FIG. 17 (*c*). At this time, in the joint part 33 between the FFC 32 and the FPC 31, the one end part of the FFC 32 is folded to sandwich the FPC 31 from both sides.

In the second embodiment, as shown in FIG. 16, the "reverse folding" is carried out to wrap around the "right-angle folded" part of the FFC 32 in the reverse direction in comparison to the first embodiment shown in FIG. 9. In other words, the folded part 322 of the second embodiment is formed by carrying out the "right-angle folding" in the reverse direction and then, carrying out the "reverse folding" also in the reverse direction in comparison to the first embodiment shown in FIG. 9. As a result, in the state of the folded part 322 sandwiching the FPC 31, a part "C" (see FIG. 16) at which the FFC 32 is connected with the FPC 31 faces the FPC 31.

The FFC 32 is then extended in the longitudinal direction of the head part 211. Then, as shown in FIG. 17 (*c*), the FFC 32 is folded in a valley fold at the alternate long and short dash line "b" so that the first part 32A is formed as shown in FIG. 17 (*d*) and the FFC 32 is folded in the direction along the longitudinal direction end part of the head part 211. Then, the FFC 32 is folded in a valley fold at the alternate long and short dash line "b" of FIG. 17 (*d*), and thus, the second part 32B is formed as shown in FIG. 17 (*e*). Next, the FFC 32 is folded in a valley fold at the respective alternate long and short dash lines "b" of FIG. 17 (*e*) and FIG. 17 (*f*). Thus, as shown in FIG. 17 (*g*), the third part 32C is formed which extends upward along the head tank 202 from the longitudinal direction end part of the head part 211.

Figure 18:
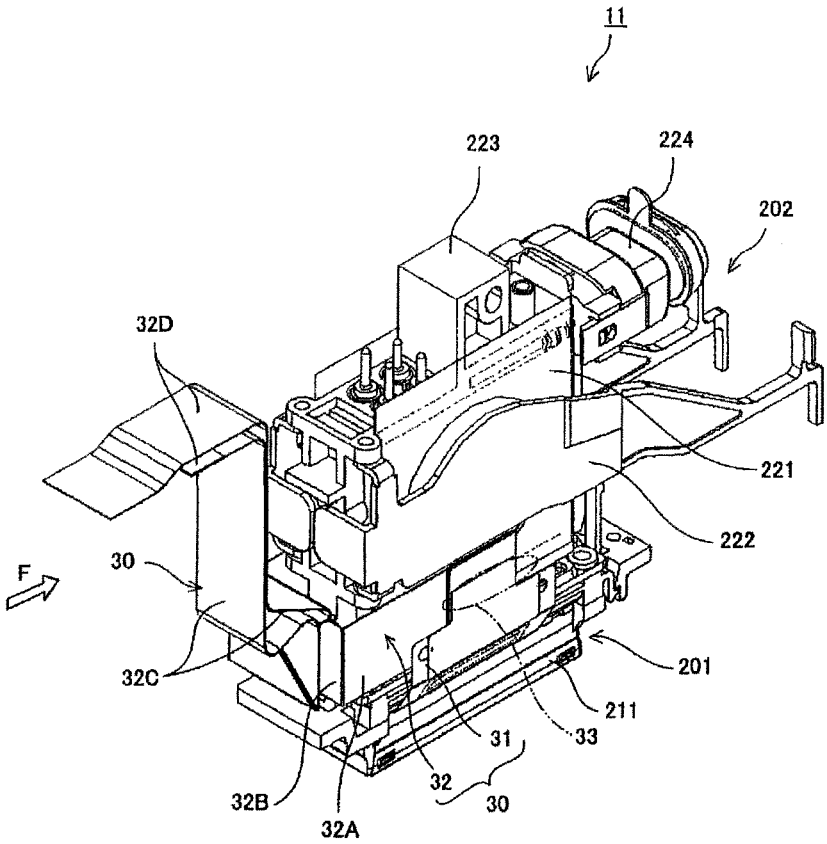
FIG. 18 shows a perspective view of an exterior appearance of a liquid discharge head unit including a liquid discharge head according to a third embodiment.
Figure 19:
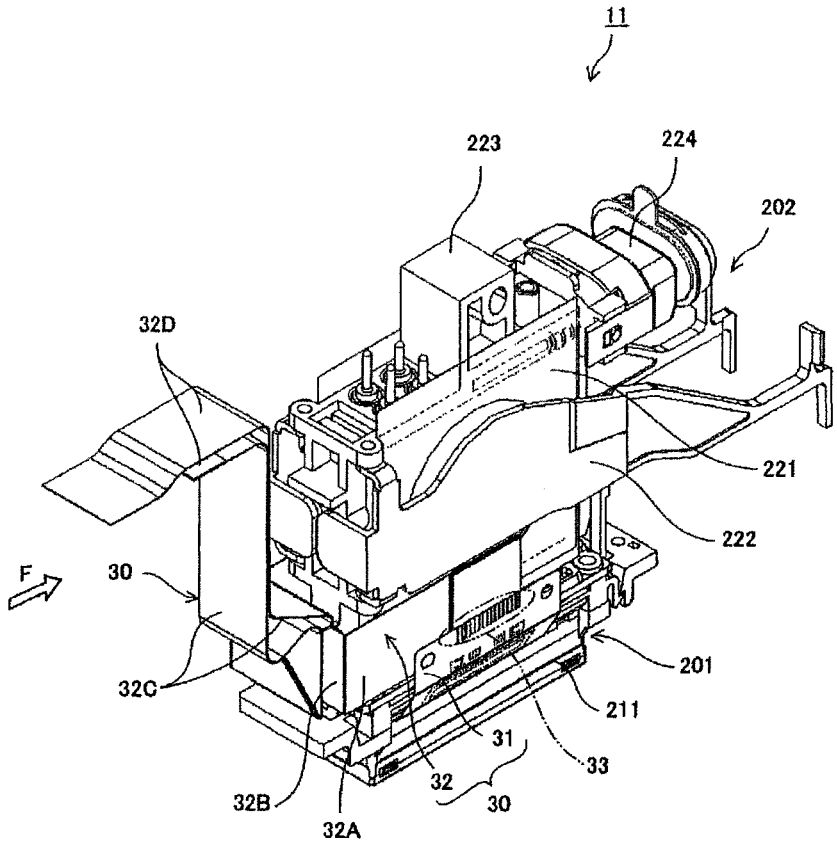
FIG. 19 shows a perspective view of an exterior appearance of FIG. 18 in a state of a reinforcement member having been removed.
Figure 20:
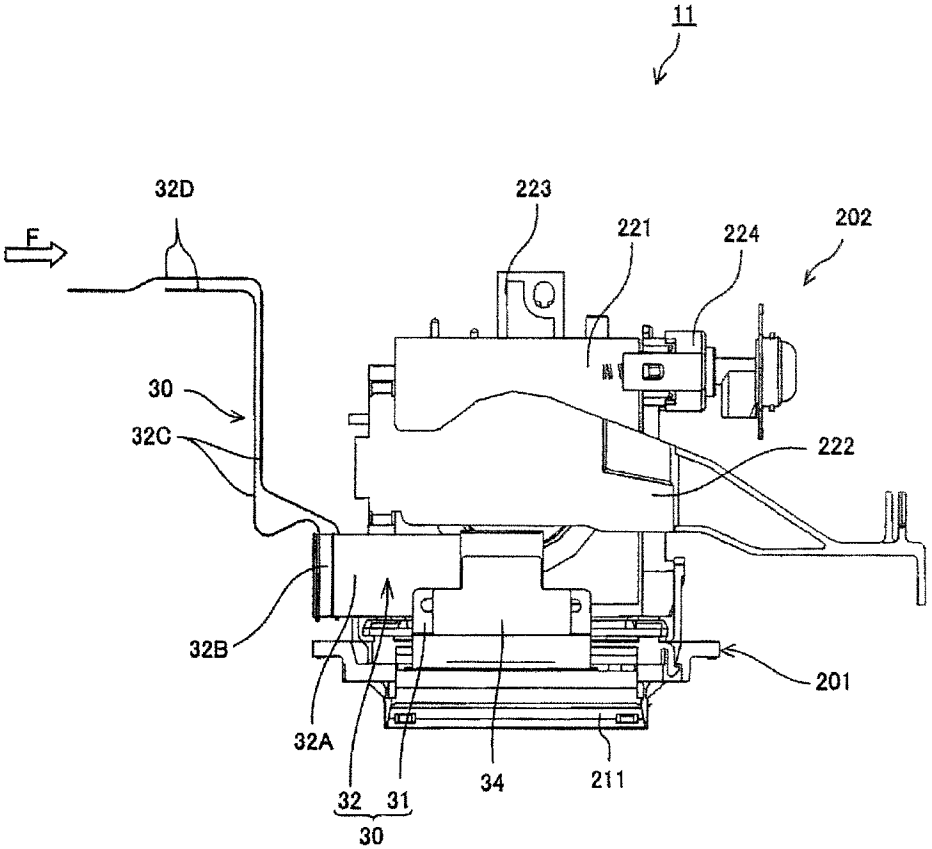
FIG. 20 shows a side view of the liquid discharge head unit according to the third embodiment.
Figure 21:
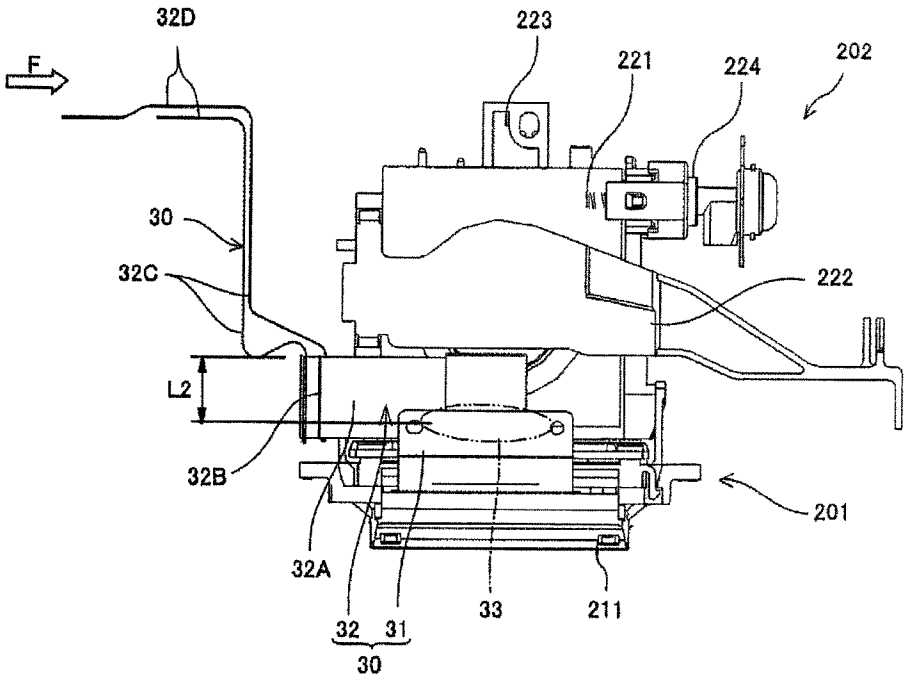
FIG. 21 shows a side view of FIG. 20 in a state of a reinforcement member having been removed.
Figure 22:
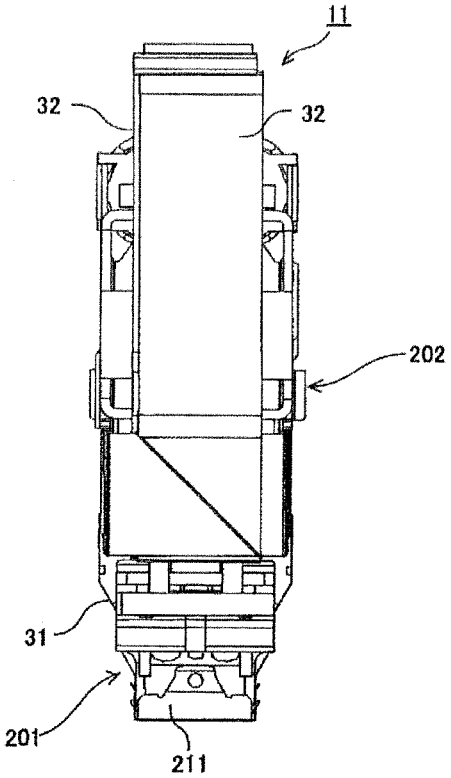
FIG. 22 shows a back view of the liquid discharge head unit according to the third embodiment.

Next, a liquid discharge head according to a third embodiment will be described using FIGS. 18 to 22. FIG. 18 shows a perspective view of an exterior appearance of a liquid discharge head unit including the liquid discharge head according to the third embodiment. FIG. 19 shows a perspective view of an exterior appearance of FIG. 18 in a state of a reinforcement member having been removed. FIG. 20 shows a side view of the liquid discharge head unit. FIG. 21 shows a side view of FIG. 20 in a state of a reinforcement member having been removed. FIG. 22 shows a back view of the liquid discharge head unit.

According to the third embodiment, fourth parts 32D are formed in respective ones of two FFCs 32 for carrying out connection with the relay substrate 17 in a horizontal direction (the direction along the nozzle surface of the head part 211, i.e., the sub-scan direction).

In this case, the lengths in the sub-scan direction of the respective fourth parts 32D of the two FFCs 32 are different. Further, by warping the third parts 32C, the third part 32C is thus made to more easily absorb the force F.

By thus configuring the FFC 32, in the third embodiment, the degree of freedom in designing the position of the connector of the relay substrate 17 is improved.

Thus, it is possible to provide the liquid discharge heads in each of which a disconnection can be avoided as a result of reducing a load such as reaction force applied to a fixable wiring member that is connected with the liquid discharge head.

The liquid discharge heads and image forming apparatuses that have the liquid discharge heads have been described above by the preferable embodiments. However, the present invention is not limited to these embodiments, and variations and modifications may be made without departing from the scope of the present invention.

For example, the above-mentioned "paper sheet" is not limited to one, the material of which is paper. Specific examples of the "paper sheet" include a sheet prepared for an OHP, glass, a substrate and so forth. That is, the "paper sheet" means one, to which an ink droplet or other liquid adheres. Specific examples of the "paper sheet" include those called a "to-be-recorded-on medium", a "recording medium", a "recording paper sheet", a "recording sheet" and so forth. Further, "image forming", "recording" and "printing" have the same meaning.

Further, the "image forming apparatus" means an apparatus that discharges liquid to a medium such as paper, thread, fiber, fabric, leather, metal, plastic, glass, wood, ceramics or the like to form an image. The "image forming" means not only giving an image having the meaning such as characters/letters, a figure, or the like, to a recording medium, but also giving an image having no meaning such as a pattern or the like to a recording medium (merely causing ink droplets to reach a recording medium).

Further, unless otherwise being particularly limited, the "ink" is not limited to one commonly referred to as ink, and may be used as a general term of all the liquids with which an image can be formed. Thus, specific examples of the "ink" include a DNA sample, resist, a patterning material, resin and so forth.

The "image" is not limited to a planar one, and specific examples thereof include an image given to an object that has a three-dimensional shape and a three-dimensional image itself obtained from three-dimensionally shaping a thing.

Further, unless otherwise being particularly limited, specific examples of the "image forming apparatus" include a serial-type image forming apparatus and a line-type image forming apparatus.

The present application is based on Japanese Priority Application No. 2012-006175 filed Jan. 16, 2012 , the entire contents of which are hereby incorporated herein by reference.

What is claimed is:

1. A liquid discharge head comprising:

a pressure generation part that generates pressure to discharge a liquid droplet; and a flexible wiring member connected with the pressure generation part, wherein the flexible wiring member includes a first flexible cable and a second flexible cable which are joined and connected, one end part of the first flexible cable is connected with the pressure generation part, and the other end part of the first flexible cable is joined with one end part of the second flexible cable, the second flexible cable is folded to have a plane part that is perpendicular to a joint area between the first flexible cable and the second flexible cable and extends in a direction away from the first flexible cable, the plane part is deformed in response to force applied from a part on which the other end part of the second flexible cable is mounted, a folded part is formed at the one end part of the second flexible cable and covers at least a part of a joint part between the other end part of the first flexible cable and the one end part of the second flexible cable, and the second flexible cable is extended in a longitudinal direction of the liquid discharge head from the folded part, the folded part of the second flexible cable is folded to sandwich the other end part of the first flexible cable and covers the joint part, and the pressure generation part is disposed on an inward-facing side of the first flexible cable.

2. The liquid discharge head as aimed in claim 1, comprising:

two of the pressure generation parts, wherein two of the second flexible cables connected to the respective pressure generation parts via the first flexible cables are folded in such a manner that at least parts of plane parts of the respective second flexible cables which plane parts face the force applied from the part on which the other end parts of the second flexible cables arc mounted overlap when viewed from a direction of the force.

3. An image forming apparatus comprising:

the liquid discharge head claimed in claim 1.

4. An image forming apparatus comprising:

the liquid discharge head claimed in claim 2.

5. A liquid discharge head comprising:

two pressure generation parts that generate pressure to discharge a liquid droplet; and two flexible wiring members connected with the respective pressure generation parts, wherein the flexible wiring member includes a first flexible cable and a second flexible cable which are joined and connected, one end part of the first flexible cable of a first flexible wiring member is connected with the pressure generation part, and the other end part of the first flexible cable of the first flexible wiring member is joined with one end part of the second flexible cable of the first flexible wiring member, the second flexible cable of the first flexible wiring member is folded to have a plane part that is perpendicular to a joint area between the first flexible cable of the first flexible wiring member and the second flexible cable of the first flexible wiring member and extends in a direction away from he first flexible cable of the first flexible wiring member, a folded part is formed at the one end part of the second flexible cable of the first flexible wiring member and covers at least a part of a joint part between the other end part of the first flexible cable of the first flexible wiring member and the one end part of the second flexible cable of the first flexible wiring member, and the second flexible cable of the first flexible wiring member is extended in a longitudinal direction of the liquid discharge head from the folded part, the folded part of the second flexible cable of the first flexible wiring member is folded to sandwich the other end part of the first flexible cable of the first flexible wiring member and covers the joint part, the pressure generation parts are disposed on inward-facing sides of the first flexible cables of the flexible wiring members, and the plane part is deformed in response to force applied from a part on which the other end part of the second flexible cable of the first flexible wiring members is mounted, wherein two of the second flexible cables of respective flexible wiring members connected to respective pressure generation parts via the first flexible cables of respective flexible wiring members are folded in such a manner that at least parts of plane parts of the respective second flexible cables which plane parts face the force applied from the part on which the other end parts of the second flexible cables are mounted overlap when viewed from a direction of the force.

6. An image forming apparatus comprising:

the liquid discharge head claimed in claim 5.

* * * * *